US009738406B2

(12) United States Patent
Bertuzzi et al.

(10) Patent No.: US 9,738,406 B2
(45) Date of Patent: Aug. 22, 2017

(54) PACKING METHOD AND UNIT FOR PRODUCING A RIGID PACKAGE WITH A HOLLOW RIB

(75) Inventors: Ivanoe Bertuzzi, Casalecchio di Reno (IT); Enrico Campagnoli, S. Agata Bolognese (IT); Marco Garganelli, Argelato (IT); Andrea Biondi, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 733 days.

(21) Appl. No.: 14/232,301

(22) PCT Filed: Jul. 16, 2012

(86) PCT No.: PCT/IB2012/053638

§ 371 (c)(1),
(2), (4) Date: Mar. 5, 2014

(87) PCT Pub. No.: WO2013/011455

PCT Pub. Date: Jan. 24, 2013

(65) Prior Publication Data

US 2014/0202118 A1 Jul. 24, 2014

(30) Foreign Application Priority Data

Jul. 15, 2011 (IT) ..... BO2011A0426
Aug. 18, 2011 (IT) ..... BO2011A0496

(51) Int. Cl.
*B65B 49/00* (2006.01)
*B65B 5/02* (2006.01)
*B65D 5/44* (2006.01)

(52) U.S. Cl.
CPC ..... *B65B 49/00* (2013.01); *B65B 5/024* (2013.01); *B65D 5/443* (2013.01);
(Continued)

(58) Field of Classification Search
CPC ..... B31B 2217/088; B31B 2217/106; B31B 2203/105; B31B 2203/267;
(Continued)

(56) References Cited

U.S. PATENT DOCUMENTS 3,941,037 A * 3/1976 Reichert ..... B31B 1/06 493/167
4,581,005 A * 4/1986 Moen ..... B31B 1/44 271/233
2007/0145105 A1* 6/2007 Bates ..... B65D 5/443 229/117.27

FOREIGN PATENT DOCUMENTS

CH 370698 A * 7/1963 ..... B65D 5/443
CN 101405191 A 4/2009
(Continued)

OTHER PUBLICATIONS

Machine Translation of EP 0494023 A1.*
International Search Report in International Patent Application No. PCT/IB2012/053638, dated Dec. 6, 2012.

*Primary Examiner* — Thanh Truong
*Assistant Examiner* — Thomas Wittenschlaeger
(74) *Attorney, Agent, or Firm* — Marshall, Gerstein & Borun LLP

(57) ABSTRACT

A packing method and unit (26) for producing a rigid package (1) with a hollow rib (12; 13); an end portion of a blank (21) is folded about a contrasting body (36; 39) onto a panel (11') of the blank (21) to form the hollow rib (12; 13); a fastening tab (16; 19), which forms the end part of the end portion, is glued to the panel (11') to stabilize the hollow rib (12; 13); and the contrasting body (36; 39) is extracted from the hollow rib (12; 13) once the end portion is folded.

9 Claims, 10 Drawing Sheets

(52) U.S. Cl.
CPC ..... *B31B 2201/2604* (2013.01); *B31B 2201/2691* (2013.01); *B31B 2203/066* (2013.01); *B31B 2203/084* (2013.01); *B31B 2203/101* (2013.01); *B31B 2203/106* (2013.01)

(58) Field of Classification Search
CPC ..... B31B 2203/101; B31B 2203/084; B31B 2203/066; B31B 2203/106; B31B 1/54; B31B 1/64; B31B 1/46; B31B 1/52; B31B 1/78; B31B 1/00; B31B 1/30; B31B 2201/2691; B31B 2201/2604; B65B 49/00; B65B 5/024; B65D 5/443
See application file for complete search history.

(56) References Cited

FOREIGN PATENT DOCUMENTS

| | | | | | |
|---|---|---|---|---|---|
| CN | 201808816 | U | 4/2011 | | |
| DE | 3336716 | A1 | 4/1985 | | |
| EP | 1 873 070 | A1 | 1/2008 | | |
| FR | 1492259 | A | 8/1967 | | |
| FR | EP 0494023 | A1 * | 7/1992 | ..... | B31B 1/52 |
| FR | 2731382 | A1 * | 9/1996 | ..... | B31B 1/46 |

* cited by examiner 21
11'
23
14
15
16
28
36
37

PACKING METHOD AND UNIT FOR PRODUCING A RIGID PACKAGE WITH A HOLLOW RIB

CROSS-REFERENCE TO RELATED APPLICATIONS

This is the U.S. national phase application of PCT/IB2012/053638, filed Jul. 16, 2012, which claims the benefit of Italian Patent Application No. BO2011A000426, filed Jul. 15, 2011, and Italian Patent Application No. BO2011A000496, filed Aug. 18, 2011.

TECHNICAL FIELD

The present invention relates to a packing method and unit for producing a rigid package with a hollow rib.

In the following description, reference is made, for the sake of simplicity and purely by way of example, to a hinged-lid chocolate box.

BACKGROUND ART

A conventional hinged-lid chocolate box comprises a parallelepiped-shaped tray for housing the chocolates (normally on a support with a seat for each chocolate) and having an open top end; and a 'flat' lid hinged to the tray along a hinge to rotate, with respect to the tray, between an open position and a closed position opening and closing the open top end respectively.

Because the chocolates are arranged in one layer, so they are all visible when the lid is opened, the tray has a large area and is low in height. As a result, the lid is also large, and, to ensure sufficient stiffness (i.e. prevent it from bending when opened) must be made thick (e.g. by superimposing and gluing together two, three or even four panels), this 'wasting' packing material.

To make a thin lid (and so save on packing material) without impairing its stiffness, it has been proposed to provide the lid with hollow peripheral ribs (i.e. running along the three free edges of the lid). The ribs normally have a triangular cross section and, being box-shaped, provide for considerable stiffness using very little packing material.

On conventional packing machines, however, folding the rigid blank along the perimeter of the lid to form the hollow ribs poses problems by frequently resulting in irregularly shaped ribs which, though structurally acceptable (even if not perfect), are totally unacceptable in terms of appearance (on account of the ribs being clearly visible when the lid is opened).

Patent Application EP1873070A1 describes a folding method and device for folding a flat blank into a parallelepiped-shaped container with four vertical hollow ribs along the four vertical edges.

DESCRIPTION OF THE INVENTION

It is an object of the present invention to provide a packing method and unit for producing a rigid package with a hollow rib, designed to eliminate the above drawbacks, and which, in particular, are cheap and easy to implement.

According to the present invention, there are provided a packing method and unit for producing a rigid package with a hollow rib, as claimed in the accompanying Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
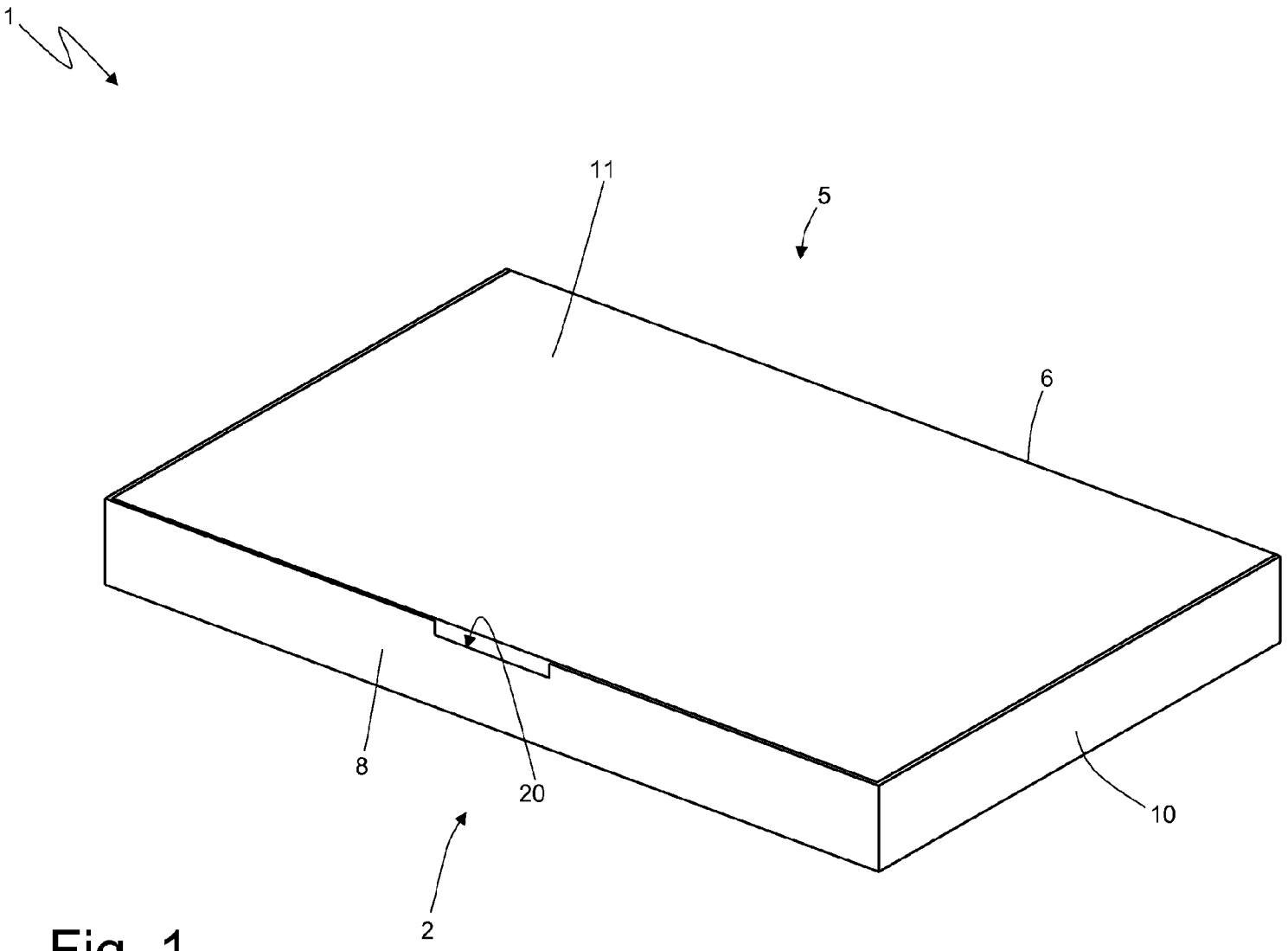
FIG. 1 shows a front view in perspective of a hinged-lid chocolate box in the closed position.
Figure 2:
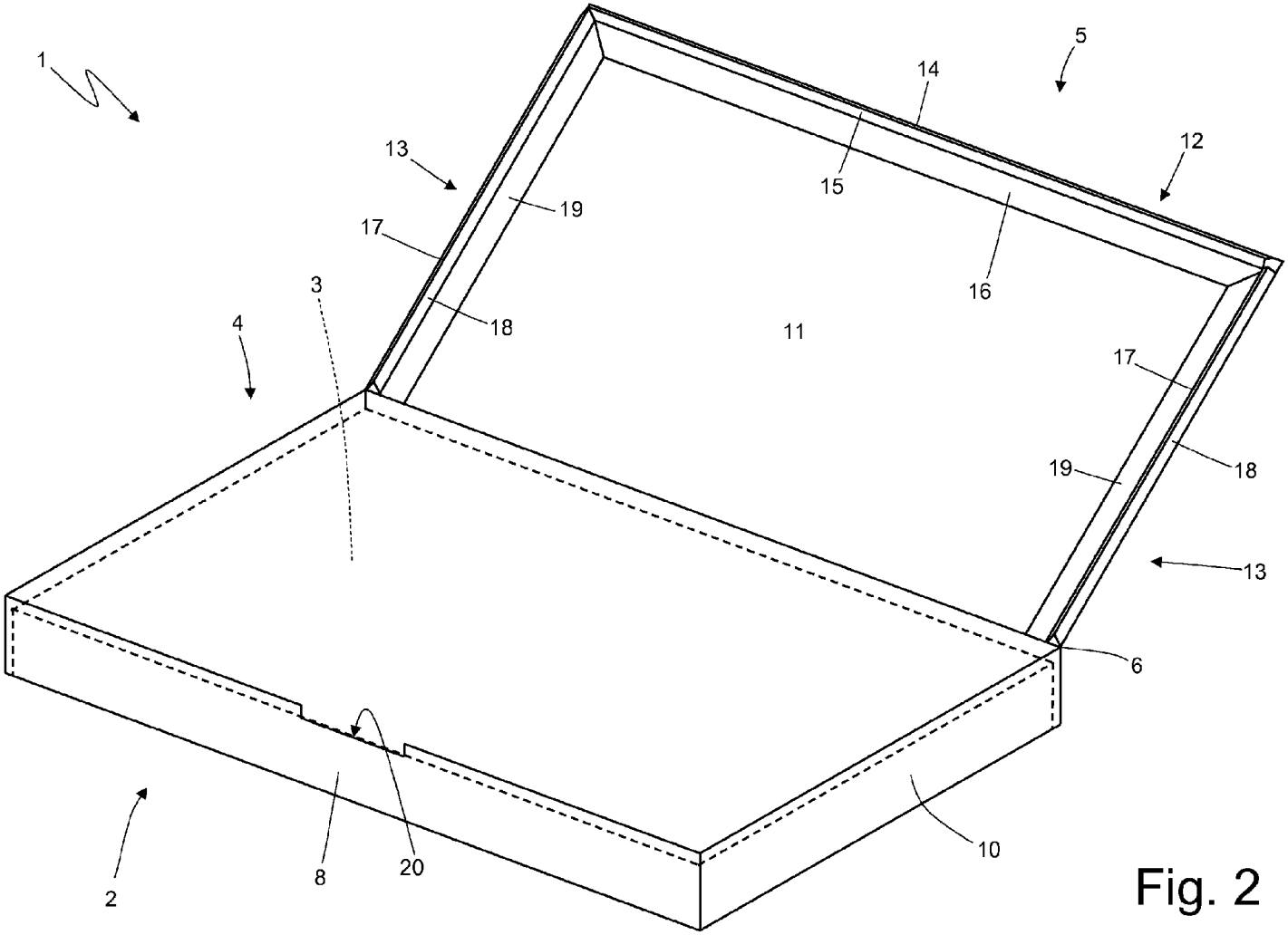
FIG. 2 shows a front view in perspective of the FIG. 1 chocolate box in the open position.
Figure 3:
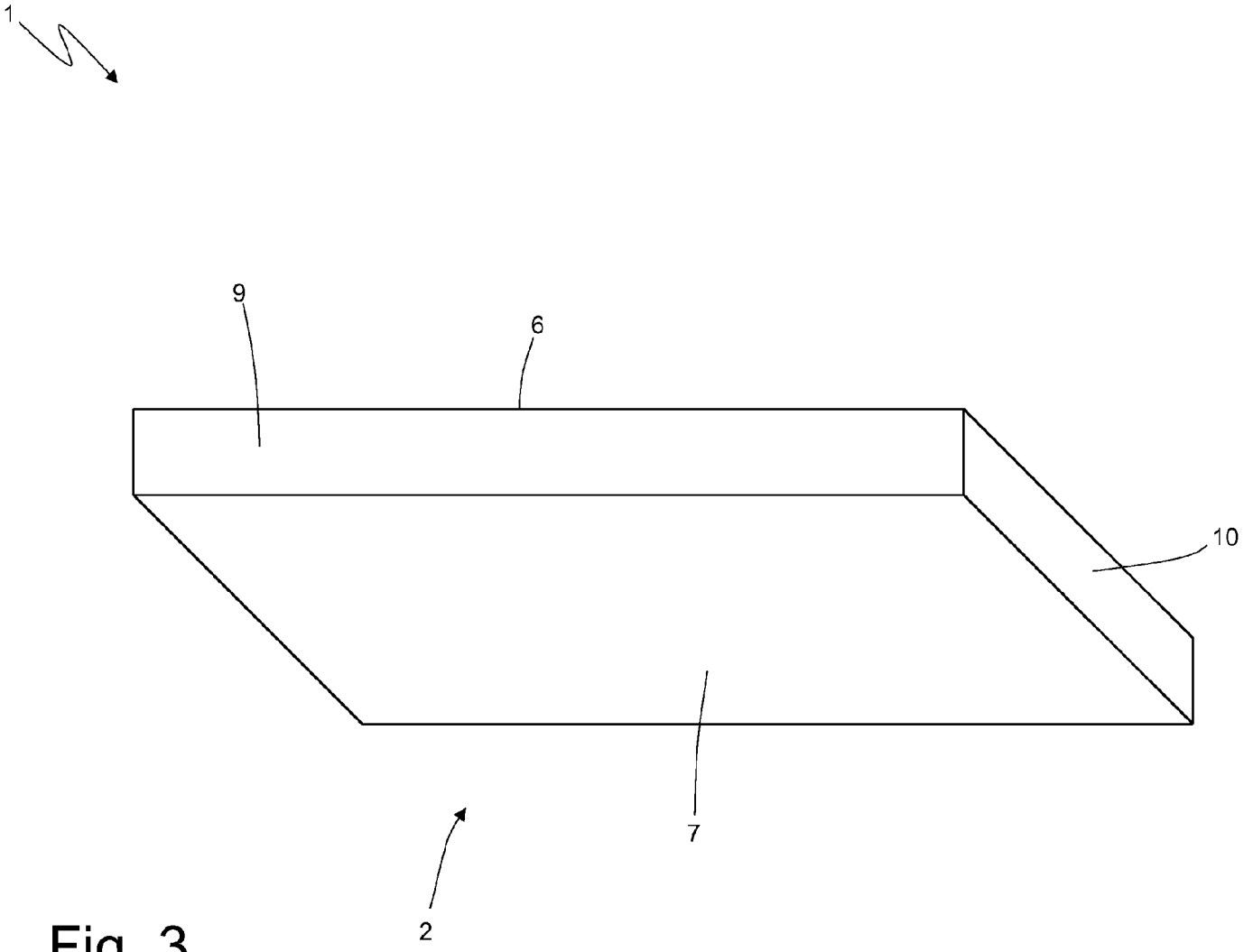
FIG. 3 shows a rear view in perspective of the FIG. 1 chocolate box in the closed position.

Number 1 in FIGS. 1-3 indicates as a whole a chocolate box comprising a parallelepiped-shaped tray 2 for housing a group 3 of chocolates. In a preferred embodiment, group 3 of chocolates is arranged in one layer, and has a support with seats for individual chocolates. Tray 2 is made of cardboard, is cup-shaped, and has an open top end 4 from which to remove the chocolates tray 2.

Chocolate box 1 comprises a substantially flat lid hinged to tray 2 along a hinge 6 to rotate, with respect to tray 2, between an open position (FIG. 2) and a closed position (FIGS. 1 and 3) opening and closing open top end 4 respectively.

Tray 2 comprises a bottom wall 7 opposite and parallel to open top end 4; a front wall 8; a rear wall 9 opposite and parallel to front wall 8 and supporting hinge 6; and two opposite parallel lateral walls 10.

Lid 5 comprises a top wall 11, which is opposite and parallel to bottom wall 7 of the tray in the closed position, and is hinged to rear wall 9 of tray 2 along hinge 6; and a hollow peripheral rib for structurally reinforcing (i.e. stiffening) top wall 11, and which extends along the three free edges of top wall 11 (i.e. the three edges not engaged by hinge 6): More specifically, the hollow peripheral rib extends downwards from an inner surface of top wall 11 of lid 5, and does not project frontwards or laterally from the outline of lid 5.

The hollow peripheral rib comprises a hollow front rib 12 extending along the free front edge of top wall 11, and which, in the closed position, faces front wall 8 of tray 2; and two hollow lateral ribs 13 extending along the free lateral edges of top wall 11, and which, in the closed position, face lateral walls 10 of tray 2. More specifically, when lid 5 is closed, hollow ribs 12 and 13 of lid 5 fit inside open top end 4 of tray 2, so that top wall 11 of lid 5 is flush with the top edges of walls 8, 9 and 10 of tray 2 (as shown in FIG. 1).

Figure 5:
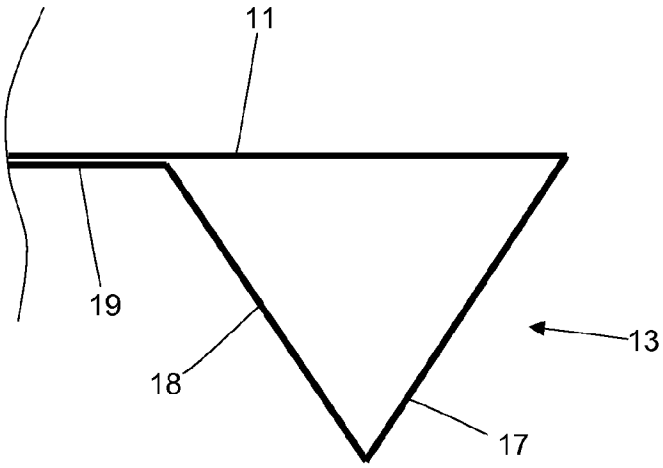
FIG. 5 shows a larger-scale cross section of a hollow lateral rib of the lid of the FIG. 1 chocolate box.
Figure 4:
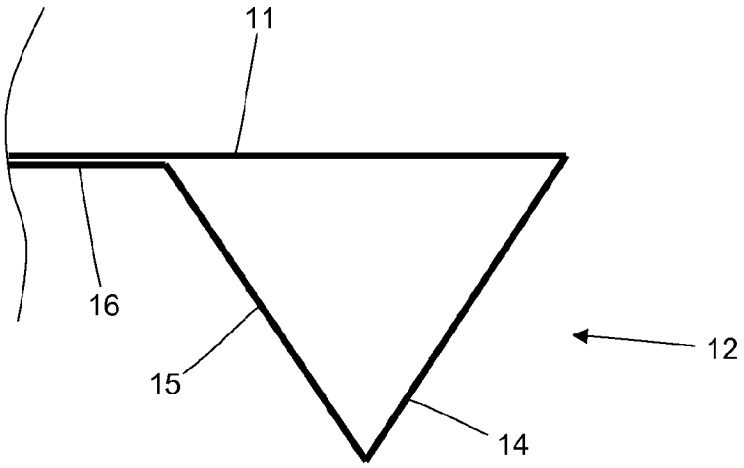
FIG. 4 shows a larger-scale cross section of a hollow front rib of the lid of the FIG. 1 chocolate box.

As shown in FIG. 4, hollow front rib 12 forms a closed box body (i.e. highly rigid while at the same time lightweight) and has a triangular cross section bounded on the outside by an outer panel 14, and on the inside by an inner panel 15; outer panel 14 and inner panel-15 form two sides of the triangle, the third side of which is formed by top wall 11; outer panel 14 is connected on one side to top wall 11 and on the other side to inner panel 15; and inner panel 15 is connected on one side to outer panel 14 and on the other side to a fastening tab 16 superimposed on and glued to top wall 11. Similarly, as shown in FIG. 5, each hollow lateral rib 13 forms a closed box body (i.e. highly rigid while at the same time lightweight) and has a triangular cross section bounded on the outside by an outer panel 17, and on the inside by an inner panel 18; outer panel 17 and inner panel 18 form two sides of the triangle, the third side of which is formed by top wall 11; outer panel 17 is connected on one side to top wall 11 and on the other side to inner panel 18; and inner panel 18 is connected on one side to outer panel 17 and on the other side to a fastening tab 19 superimposed on and glued to top wall 11.

In a preferred embodiment shown in FIG. 1, front wall 8 of tray 2 has a through opening 20 enabling the user to push the closed lid 5 up into the open position.

Figure 6:
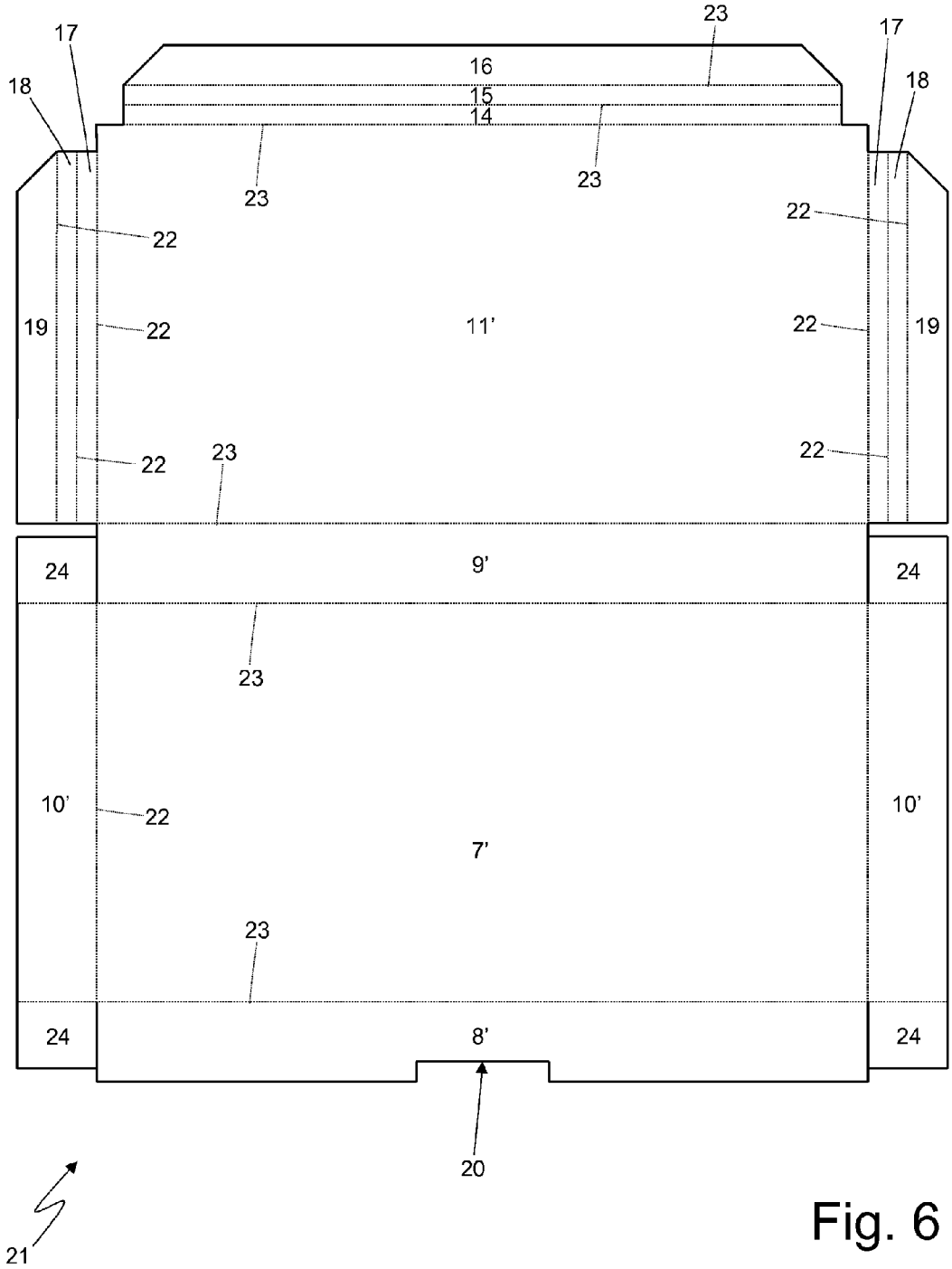
FIG. 6 shows a spread-out view of a blank from which to form the FIG. 1 chocolate box.

As shown in FIG. 6, chocolate box 1 is formed by folding a flat, substantially elongated rectangular cardboard blank 21, the parts of which are indicated, where possible, in the following description using the same reference numbers, with superscripts, as for the corresponding parts of chocolate box 1.

Blank 21 has two longitudinal fold lines 22, and a number of transverse fold lines 23, which define, between longitudinal fold lines 22, a panel 11' forming top wall 11 of lid 5; a panel 9' forming rear wall 9 of tray 2; a panel 7' forming bottom wall 7 of tray 2; and a panel 8' forming front wall 8 of tray 2.

Panel 7' has two lateral wings 10', which are located on opposite sides of panel 7', are separated from panel 7' by longitudinal fold lines 22, and form lateral walls 10 of tray 2. Each wing 10' has two rectangular tabs 24 located at opposite ends of wing 10', and which are glued to the inside of panels 9' and 8' respectively when folding blank 21.

Outer panel 14 of hollow front rib 12 is connected to panel 11' along a transverse fold line 23; inner panel 15 of hollow front rib 12 is connected to outer panel 14 along another transverse fold line 23; and fastening tab 16 of hollow front rib 12 is connected to inner panel 15 along yet another transverse fold line 23.

The outer panel 17 of each hollow lateral rib 13 is connected to panel 11' along a longitudinal fold line 22; the inner panel 18 of each hollow lateral rib 13 is connected to outer panel 17 along another longitudinal fold line 22; and the fastening tab 19 of each hollow lateral rib 13 is connected to inner panel 18 along another longitudinal fold line 22.

Figure 7:
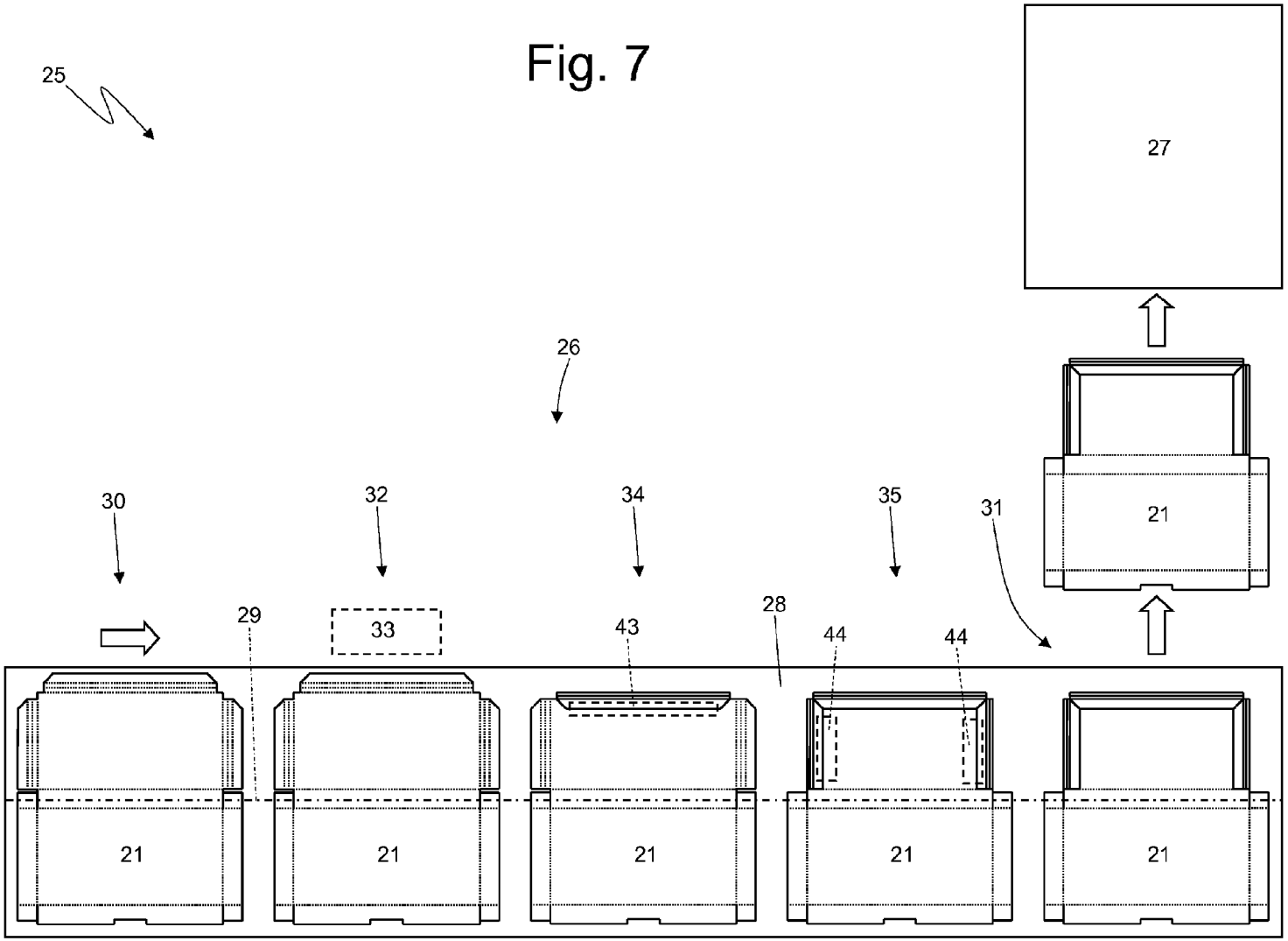
FIG. 7 shows a partial schematic of a packing machine for producing the FIG. 1 chocolate box.

FIG. 7 shows a partial schematic of a packing machine 25 for folding a blank 21 about a group 3 of chocolates to form chocolate box 1 as described above. Packing machine 25 comprises a packing unit 26 for prefolding the flat blank 21 to form the hollow peripheral rib before applying blank 21 to group 3 of chocolates; and a known packing unit 27, which receives the prefolded blank 21 (i.e. on which the hollow peripheral rib has been formed) from packing unit 26, and folds blank 21 about group 3 of chocolates to form chocolate box 1.

Packing unit 26 comprises a belt conveyor 28, which feeds blanks 21 successively and in steps (i.e. in cyclically alternating stop-go steps) along a straight folding path 29 parallel to transverse fold lines 23 (i.e. to hollow front rib 12) and perpendicular to longitudinal fold lines 22 (i.e. to hollow lateral ribs 13). Belt conveyor 28 receives blanks 21, at an input station 30, from a feed device (not shown) designed to withdraw blanks 21 from the bottom outlet of a hopper (not shown), and feeds blanks 21 along folding path 29 to an output station 31, where blanks 21 are removed from belt conveyor 28 and fed, perpendicularly to folding path 29, to packing unit 27.

Belt conveyor 28 preferably comprises a number of endless conveyor belts (not shown individually), which are lopped at the ends about respective shared pulleys, are spaced apart, may be fitted with teeth projecting perpendicularly upwards to form a succession of pockets for blanks 21, and may also be provided with suction for retaining blanks 21.

Along folding path 29 from input station 30 to output station 31, belt conveyor 28 feeds blanks 21 successively through a gumming station 32, where spots of hot-melt (fast-dry) glue are deposited on blank 21 by a gumming device 33; a folding station 34 for forming hollow front rib 12; and a folding station 35 for forming hollow lateral ribs 13. Gumming device 33 at gumming station 32 deposits spots of glue onto fastening tabs 16 and 19 and/or panel 11' to glue fastening tabs 16 and 19 to panel 11' once hollow ribs 12 and 13 are folded. An alternative embodiment (not shown) may have a first gumming station directly upstream from folding station 34 to gum fastening tab 16 of blank 21; and second gumming station directly upstream from folding station 35 to gum fastening tabs 19 of blank 21. In another embodiment not shown, folding stations 34 and 35 may be inverted, i.e. station 34 folding hollow front rib 12 may be located downstream (as opposed to upstream) from station 35 folding hollow lateral ribs 13. And gumming device 33 may gum blank 21 with either spots of hot-melt glue only, or also with spots of cold glue (which takes longer to dry but is stronger than hot-melt glue).

As shown in FIGS. 8-16, folding station 34 has a fixed contrasting body 36 (i.e. located in a fixed position and having no movement), which is the same shape and size as hollow front rib 12, and is positioned parallel to folding path 29 (i.e. to transverse fold lines 23 and hollow front rib 12). At folding station 34, the end portion of blank 21 forming hollow front rib (i.e. outer panel 14, inner panel 15, and fastening tab 16) is folded about contrasting body 36 onto panel 11' to form hollow front rib 12.

The end portion of blank 21 forming hollow front rib 12 is folded by a fixed folding screw 37 (i.e. located in a fixed position and having no movement) as blank 21 moves along folding path 29. In other words, as it moves along folding path 29, blank 21 slides against fixed folding screw 37, which gradually folds the end portion of blank 21 forming hollow front rib 12 (i.e. outer panel 14, inner panel 15 and fastening tab 16). It is important to note that fixed folding screw 37 is located in the gap between two adjacent conveyor belts of belt conveyor 28. In a different embodiment not shown, a movable folding device is substituted for fixed folding screw 37.

Figure 9:
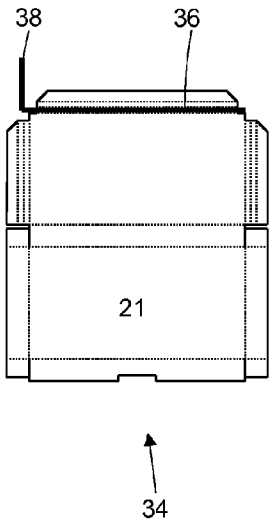
FIGS. 8-11 show four schematic plan views of respective consecutive steps in producing the FIG. 4 hollow front rib.
Figure 8:
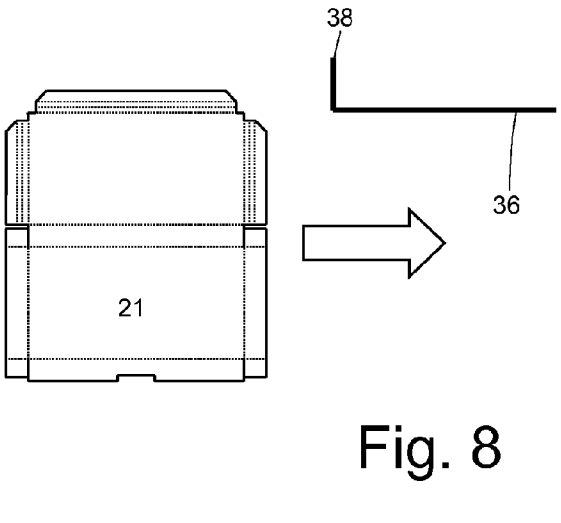
Figure 11:
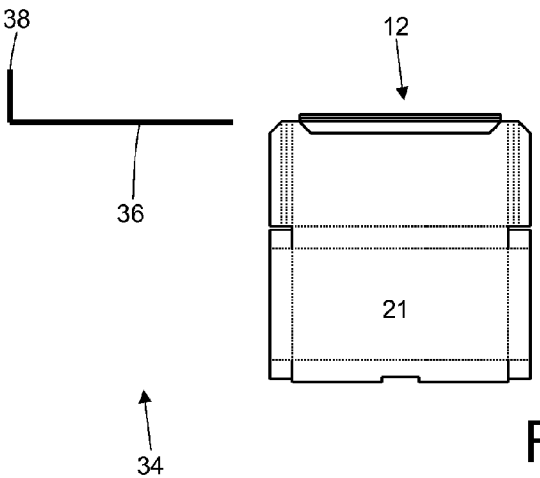
Figure 10:
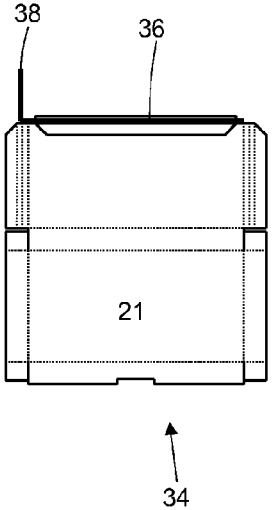
Figures 12, 13, 14, 15, 16:
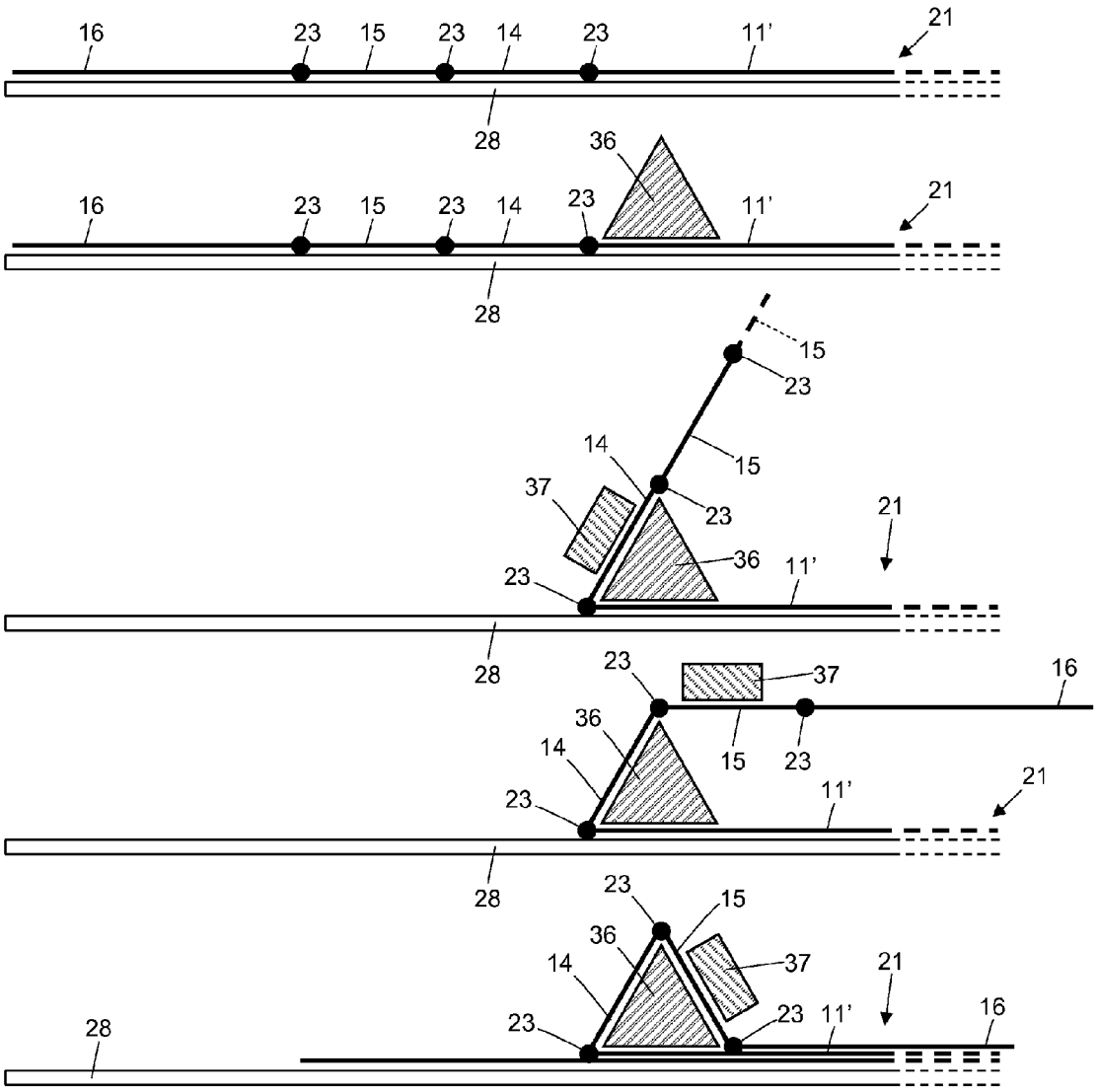
FIGS. 12-16 show five schematic cross sections of respective consecutive steps in producing the FIG. 4 hollow front rib.

As shown in FIGS. 8 and 9, contrasting body 36 is elongated parallel to folding path 29, and is located in a fixed position along folding path 29 at folding station 34, so blank 21 moves along folding path 29 into position beneath contrasting body 36. As shown in FIGS. 10 and 11, once hollow front rib 12 is folded, contrasting body 36 is extracted from hollow front rib 12 by blank 21 moving along folding path 29. For this reason, contrasting body 36 is only supported in projecting manner at one end by a support 38 located upstream in the travelling direction of blank 21 along folding path 29. More specifically, support 38 passes over blank 21 before hollow front rib 12 is folded, and so allows contrasting body 36 to be extracted laterally from hollow front rib 12.

As shown in FIGS. 17-24, folding station 35 has two movable contrasting bodies 39 movable perpendicularly to folding path 29), each of which is the same shape and size as corresponding hollow lateral rib 13, and is positioned perpendicular folding path 29 (i.e. parallel to longitudinal fold lines 22 and hollow lateral ribs 13). At folding station 35, each end portion of blank 21 forming a hollow lateral rib 13 (i.e. outer panel 17, inner panel 18, and fastening tab 19) is folded about respective contrasting body 39 onto panel 11' to form respective hollow lateral rib 13.

Figure 23:
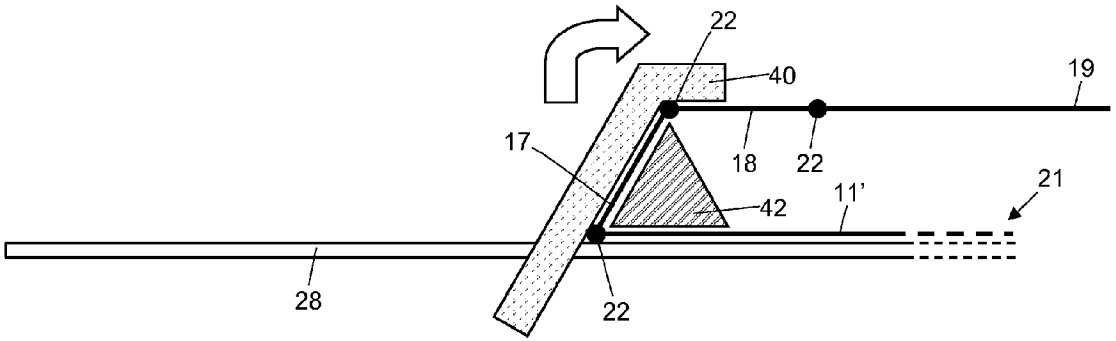
Figure 24:
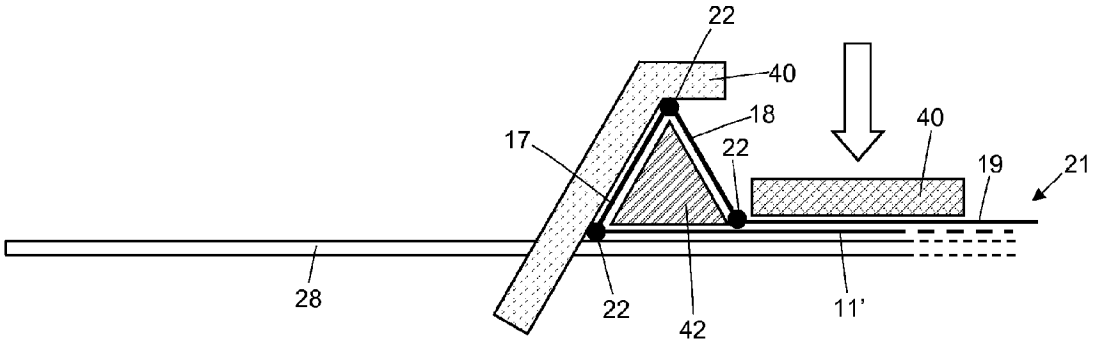

As shown in FIGS. 23 and 24, the end portions of blank 21 forming hollow lateral ribs 13 are folded by two movable folding devices 40 when blank 21 is stopped along folding path 29. In a preferred embodiment, each folding device 40 is comb-shaped to fit inside the gaps between adjacent conveyor belts of belt conveyor 28.

Figure 18:
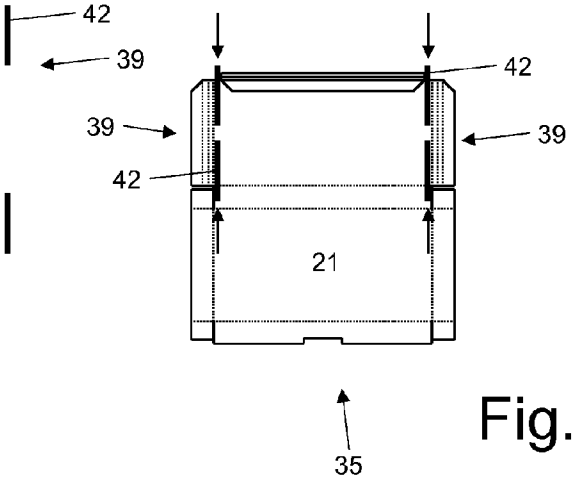
FIGS. 17-20 show four schematic plan views of respective consecutive steps in producing two hollow lateral ribs as shown in FIG. 5.
Figure 17:
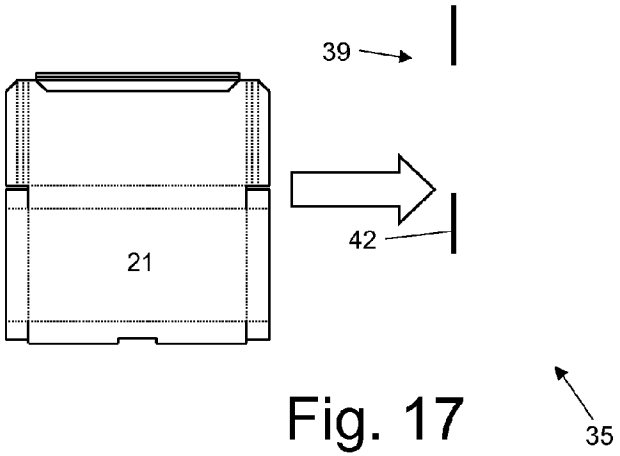
Figure 20:
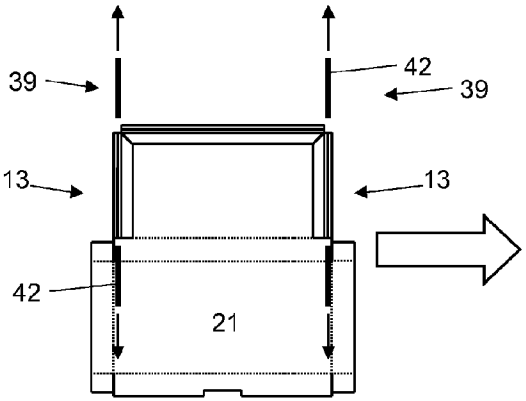
Figure 19:
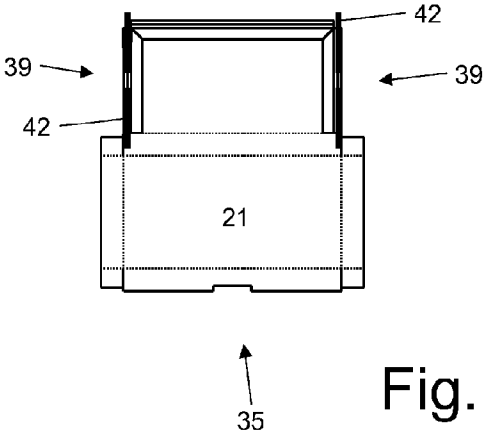
Figure 21:
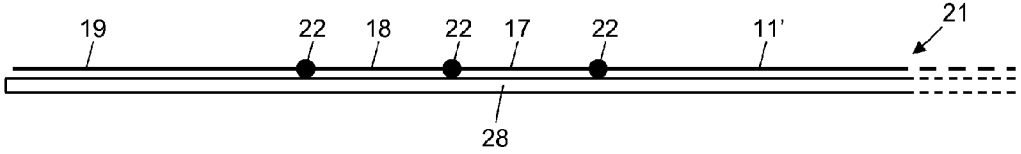
FIGS. 21-24 show four schematic cross sections of respective consecutive steps in producing a hollow lateral rib as shown in FIG. 5.
Figure 22:
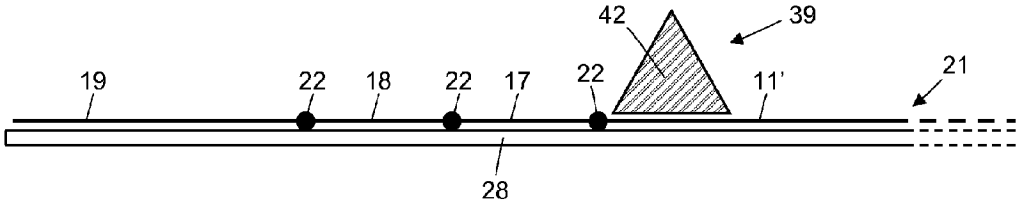

As shown in FIGS. 17-20, each contrasting body 39 comprises two separate parts 42, which are movable, in opposite directions perpendicular to folding path 29 (i.e. parallel to longitudinal fold lines 22 and hollow lateral ribs 13), between an engaged position (Figures and 19), in which the two parts 42 of contrasting body 39 are located at relative hollow lateral rib. 13, and a release position (FIGS. 17 and 20), in which the two parts 42 of contrasting body 39 are-located outwards of relative hollow lateral rib 13. The two parts 42 of each contrasting body 39 are set to the release position (FIG. 17) to let blank 21 into folding station 35, and, once blank 21 moves into folding station 35, are moved from the release position to the engaged position to fold blank 21 about the two contrasting bodies 39 and form the two hollow lateral ribs 13 (FIGS. 18 and 19). Once blank 21 is folded, the two parts 42 of each contrasting body 39 are moved from the engaged position to the release position to extract contrasting body. 39 from hollow lateral rib 13 and allow blank 21 to move on from folding station 35 to the next output station 31 (FIG. 20).

As shown in FIG. 20, each contrasting body 39 (i.e. the two parts 42 of each contrasting body 39) is moved with respect to blank 21, in a straight direction parallel to hollow lateral rib 13, from the engaged position to the release position to extract contrasting body 39 from hollow lateral rib 13.

In different embodiment not shown, each contrasting body 39 only comprises one part 42, which moves, in a straight direction parallel to hollow lateral rib 13, from the engaged position to the release position to extract contrasting body 39 from hollow lateral rib 13.

In a different embodiment not shown, each contrasting body 39 moves along a non-straight, e.g. at least partly curved or totally curved, path from the engaged position to the release position to extract contrasting body 39 from hollow lateral rib 13.

In a preferred embodiment shown in FIG. 7, folding station 34 comprises a pressure device 43, which, after hollow front rib 12 is formed (i.e. as soon as fastening tab 16 is folded onto panel 11'), exerts pressure on fastening tab 16 to hold it firmly on panel 11' long enough for the glue between fastening tab 16 and panel 11' to dry and stabilize the shape of hollow front rib 12, i.e. to prevent undesired movement (e.g. springback) of fastening tab 16 with respect to panel 11' once hollow front rib 12 is formed and until the glue between fastening tab 16 and panel 11' dries.

In one embodiment, pressure device 43 only moves perpendicular to panel 11', and only exerts pressure on fastening tab 16 as long as blank 21 is stopped at folding station 34 (i.e. pressure device 43 is lifted off fastening tab 16 to allow blank 21 to move on to folding station 35).

In another embodiment, pressure device 43 is movable both perpendicular to panel 11' (up and down with respect to fastening tab 16) and parallel to folding path 29 (to follow blank 21 along folding path 29 and downstream from folding station 34), and stays pressed against fastening tab 16 even downstream from folding station 34, to give the glue between fastening tab 16 and panel 11' more time to dry. Pressure device 43 can accompany blank 21 as far as folding station 35, where it must ultimately be lifted off blank 21 to fold hollow lateral ribs 13. In the FIG. 7 embodiment, folding station 35 is located directly downstream from folding station 34, whereas, in an equivalent embodiment not shown, one or more intermediate stations are provided between folding stations 34 and 35 to increase the distance between folding stations 34 and 35 and give the glue more time to dry.

In a preferred embodiment shown in FIG. 7, folding station 35 comprises a pressure device 44 identical to pressure device 43 described above, and which, after hollow lateral ribs 13 are formed (i.e. as soon as fastening tabs 19 are folded onto panel 11'), exerts pressure on the two fastening tabs 19 to hold them firmly on panel 11'. Like pressure device 43, pressure device 44 may either only move perpendicular to panel 11', or also parallel to folding path 29. In which latter case, one or more intermediate stations may be provided between folding station 35 and output station 31 to increase the distance between stations 35 and 31 and give the glue more time to dry.

In a different embodiment not shown, the hollow peripheral rib of lid 5 (mainly for aesthetic reasons) has an other than triangular (e.g. square, semicircular, trapezoidal) cross section. Compared with a triangular cross section using the same amount of material, however, a square cross section provides for less rigidity of lid 5.

The packing method described has numerous advantages.

In particular, it provides for forming an extremely precise hollow peripheral rib on lid 5, i.e. of exactly the desired shape and with no noticeable deformation.

Also, the packing method described is extremely cheap and easy to implement, by only requiring, with respect to a similar standard packing unit, the addition of a few fixed parts (contrasting body 36, folding screw 37) or elementary moving parts (movable contrasting bodies 39 and the two movable folding devices 40).

Given its numerous advantages, the packing method described may also be used to advantage to produce hollow peripheral ribs on rigid packages other than pens or crayons) or cigar boxes, and to produce hollow inner ribs on rigid packages.

The invention claimed is:

1. A packing method for producing a rigid package with a hinged lid, which has a top wall with first, second, and third hollow ribs extending along the perimeter of the top wall, and forming together a U-shape; the packing method comprising the steps of:

applying glue to fastening tabs of a blank, wherein the blank comprises a panel that corresponds to the top wall of the hinged lid, and first, second, and third end portions extending along three sides of the perimeter of the panel, and the fastening tabs form the end part of each of the end portions and are glued to the panel to stabilize each hollow rib when the hollow rib is formed;

feeding a blank along a straight folding path to a first folding station;

positioning, at the first folding station, a first contrasting body close to the first end portion of the panel;

folding the first end portion in a direction parallel to the folding path about the first contrasting body to form the first hollow rib;

extracting the first contrasting body from the first hollow rib once the first end portion is folded;

feeding the blank along the straight folding path to a second folding station that is downstream of and separate from the first folding station;

positioning, at the second folding station, second contrasting bodies close to the second and third end portions, respectively;

folding each of the second and third end portions in a direction perpendicular to the folding path about the respective second contrasting body to form the second and third hollow ribs, respectively;

extracting the second contrasting bodies from the second and third hollow ribs once the second and third end portions are folded;

exerting pressure on a first fastening tab using a first pressure device, after the first hollow rib is formed, to keep the fastening tab in firm contact with the panel;

applying the blank to an article downstream from the first and second folding stations; and folding the blank about the article to form the rigid package enclosing the article and having the hinged lid; exerting pressure on second and third fastening tabs using two second pressure devices, after the second and third hollow ribs are formed wherein each pressure device is movable perpendicular to the panel and up and down with respect to the fastening tab, as well as parallel to the folding path to follow the blank along the folding path downstream from the respective folding station where the hollow rib is formed.

2. A packing method as claimed in claim 1, wherein each of the contrasting bodies is the same shape as the respective first, second, and third hollow rib formed therefrom.

3. A packing method as claimed in claim 1, and comprising the further steps of:

placing the first contrasting body in a fixed position along the folding path, so the blank moves along the folding path into position beneath the first contrasting body; and extracting the first contrasting body from the first hollow rib by feeding the blank along the folding path.

4. A packing method as claimed in claim 3, wherein the first contrasting body is elongated parallel to the folding path.

5. A packing method as claimed in claim 3, wherein the first contrasting body is only supported in projecting manner at one end located upstream in the travelling direction of the blank along the folding path.

6. A packing method as claimed in claim 1, and comprising the further step of moving each second contrasting body, with respect to the blank, from an engaged position to a release position, to extract each of the second contrasting bodies from the respective second and third hollow ribs.

7. A packing method as claimed in claim 1 and comprising the further steps of:

placing the first contrasting body in a fixed position along the folding path at the first folding station, so the blank moves along the folding path into position beneath the first contrasting body;

extracting the first contrasting body from the first hollow rib by moving the blank along the folding path; and moving each second contrasting body at the second folding station, with respect to the blank and in a straight direction parallel to the second and third hollow ribs, from an engaged position to a release position, to extract each of the second contrasting bodies from the respective second and third hollow ribs.

8. A packing method as claimed in claim 1, wherein each pressure device is only movable perpendicular to the panel, and only exerts pressure on the fastening tab as long as the blank is stationary at the folding station where the hollow rib is formed.

9. A packing unit for producing a rigid package with a hinged lid, which has a top wall with three hollow ribs extending along the perimeter of the top wall and forming together a U-shape; the packing unit comprising:

at least one gumming device for applying a glue to one or more fastening tabs of a blank, wherein the blank comprises a panel that corresponds to the top wall of the hinged lid, and first, second, and third end portions extending along three sides of the perimeter of the panel, and the fastening tabs form the end part of each end portion and are glued to the panel to stabilize each hollow rib when the hollow rib is formed;

a first folding station comprising:

a first contrasting body, which is positioned close to the panel before folding the first end portion;

a first folding device, which folds the first end portion about the first contrasting body in a direction parallel to a straight folding path to form the first hollow rib; and a first actuating device for extracting the first contrasting body from the first hollow rib once the first end portion is folded; and a first pressure device which exerts pressure on a first fastening tab, after the first hollow rib is formed, to keep the first fastening tab in firm contact with the panel;

a second folding station separate from and positioned downstream of the first folding station, the second folding station comprising:

second contrasting bodies, each second contrasting body positioned against one of the second or third end portions;

a second folding device, which folds the second and third end portions about the respective second contrasting body in a direction perpendicular to the folding path about the respective second contrasting body;

a second actuating device for extracting the second contrasting bodies from the second and third hollow ribs, respectively, once the second and third end portions are folded; and two second pressure devices which exert pressure on second and third fastening tabs, after the second and third hollow ribs are formed, to keep the second and third fastening tabs in firm contact with the panel;

a conveyor for feeding the blank along the straight folding path through the first folding station and through the second folding station; and a packing unit for applying the blank to an article downstream from the first and second folding stations, and folding the blank about the article to form the rigid package enclosing the article and having the hinged lid;

wherein each pressure device is movable perpendicular to the panel and up and down with respect to the fastening tab, as well as parallel to the folding path to follow the blank along the folding path downstream from the respective folding station where the hollow rib is formed.

* * * * *